US006647682B2

(12) United States Patent
Bishop

(10) Patent No.: US 6,647,682 B2
(45) Date of Patent: Nov. 18, 2003

(54) DRAIN PIPE CONNECTOR

(75) Inventor: Bernard Bishop, Des Plaines, IL (US)

(73) Assignee: Portals Plus, Inc., Bensenville, IL (US)

( * ) Notice: Subject to any disclaimer, the term of this patent is extended or adjusted under 35 U.S.C. 154(b) by 130 days.

(21) Appl. No.: 09/935,481

(22) Filed: Aug. 23, 2001

(65) Prior Publication Data

US 2003/0037498 A1 Feb. 27, 2003

(51) Int. Cl.[7] ..... E04D 13/04

(52) U.S. Cl. ..... 52/302.1; 285/42; 277/608; 210/163

(58) Field of Search ..... 52/302.1; 285/42; 277/608; 210/163

(56) References Cited

U.S. PATENT DOCUMENTS

| | | | | | |
|---|---|---|---|---|---|
| 1,710,304 | A | * | 4/1929 | Flynn et al. | 285/42 |
| 1,779,936 | A | * | 10/1930 | Hess | 285/263 |
| 3,893,919 | A | * | 7/1975 | Flegel et al. | 210/166 |
| 5,618,416 | A | * | 4/1997 | Haefner | 210/163 |
| 5,724,777 | A | * | 3/1998 | Hubbard | 52/198 |
| 5,966,884 | A | * | 10/1999 | Uglow | 52/302.1 |
| 6,168,208 | B1 | * | 1/2001 | Thaler | 285/42 |

* cited by examiner

*Primary Examiner*—Jeanette Chapman
(74) *Attorney, Agent, or Firm*—Dillis V. Allen, Esq.

(57) ABSTRACT

A means to engage two vertical pipes or tubes of unlike and increasing size that have been co-inserted such as with a roof or floor drain, in a manner that prevents the contained fluid from overspilling when the said pipes become full or when the fluid flows in a direction opposite from normal gravity flow, which is generally considered as flow from the smaller to the larger pipe. The means of engagement closes the void between the inside diameter larger pipe and outside diameter smaller pipe to withstand fluid pressure in a way that accounts for angular misalignment, pipe or tube eccentricity, manufacturing tolerance, as well as tube condition and debris attached to either pipe sidewall. More specifically, a roof drain system for existing roofs or new construction including a flanged outlet pipe for insertion into the roof drain pipe with the flange mounted on top of the roof. A water straining system is mounted on top of the flange. The outlet pipe is sealed to the interior of the drain pipe by a one-piece rubber molding seal that flexes to easily slide into the drain pipe and withstands high backup water pressures from the drain pipe without leaking. The seal has a Shore A durometer in the range of 30 to 95 and has an annular portion engaging the outer surface of the outlet pipe and an integral flange portion extending outwardly and downwardly from the upper end of the annular portion that seals the inner surface of the drain pipe.

13 Claims, 2 Drawing Sheets

DRAIN PIPE CONNECTOR

BACKGROUND OF THE INVENTION

The present invention relates to a flexible membrane device that assumes the gap between two unlike sized pipes or tubes, where as the smaller of the two pipes is inserted vertically downward into the larger pipe and the flexible membrane prevents egress of internal fluids outside of the pipe confines if, for example, the pipes become full and fluid pressure occurs, or if fluid flow direction is reversed and velocity pressure occurs. More specifically, the present invention relates to roof draining systems that are adapted to be retrofitted into existing roof drain pipes usually at the time the roof is re-roofed. It should be understood, however, that the principles of the present invention can be utilized in new construction as well as in re-roofing systems. Generally, re-roofing drain systems include an outlet pipe having an upper flange mountable on roof insulation or roofing material. In some cases, the outlet pipe is sealed to the interior of the drain pipe by a pre-compressed foam material but other forms of seals described below have been used as well. A rib on the top of this flange sometimes mates with a groove on a cast aluminum gravel guard collar, which in essence is a ring element that provides a flashing lock to the flange with a roofing membrane clamped between the collar and the flange. The flange and the outlet tube are frequently available in stainless steel, PVC, aluminum or high temperature ABS and are available to accommodate but not limited to 2, 3, 4, 5, and 6 inch drains. The drain can be installed on an existing roof top without special tools and the hardware is frequently stainless steel. A straining system is sometimes provided on top of the clamping ring that includes a one-piece dome-type strainer.

When re-roofing is necessary, the original drain systems must be replaced in part because of rusted bolts and frequently the gravel ring breaks upon removal.

The present invention relates particularly to the methodology for sealing the outlet pipe to the interior of the drain pipe. This is an essential function in re-roof drain systems because backup water pressure from the drain pipe, if it escapes around the outlet pipe, will find its way to an area underneath the roof and into the building interior.

One system for sealing designed by the assignee of the present invention is a pre-compressed foam tape glued to the exterior of the outlet pipe. Just prior to installation of the outlet pipe, the installer removes the pre-compressed tape permitting the foam to expand as the outlet pipe is inserted into the existing drain pipe. This system has been found satisfactory but in some cases, insertion into the drain pipe has been found difficult and if the outer diameter of the pre-compressed foam is decreased to facilitate insertion into the drain pipe, some leakage will occur particularly upon backup water pressures of 50 column feet or more. Immediately upon removing the tape and prior to the full expansion of the foam, the smaller pipe is inserted and positioned in the larger pipe. The foam continues to expand at a rate effected by ambient temperature and other conditions until restricted by the void between the two pipes. This system has been found satisfactory in some cases, but insertion into the drain pipe has been found difficult based on installer skill or speed, and ambient conditions. Unlike the present invention, this type seal may experience some leakage around the wrapped joint or through the foam material when subjected to fluid pressure.

Other roofing systems include one-piece rubber seals that are somewhat more relevant to the present invention than the above-described assignee's expandable foam system. One such seal is manufactured by Zurn Industries, Inc. of Pittsburgh, Pa., and it includes a one-piece elastomeric seal having a plurality of thin annular rings there-around that are integral with the seal.

Another re-roofing seal is made by Thaler Metal Industries, Inc., Model No. M-22, and this system includes a one-piece elastomeric seal constructed of EPDM Posiseal that is similar in construction to the Zurn seal described above.

U-Flow, Inc. has a mechanical compression seal adapter positioned immediately below the roof deck. This annular seal, Model Nos. UF-3 to UF-6 include a heavy annular section with an even heavier lower annular seal portion that engages the inside diameter of the drain pipe. This seal is largely inflexible. This seal requires axial compression with a plurality of threaded members after insertion into the drain pipe to effect radial expansion and sealing against the drain pipe, making it very difficult to operate and unpredictable. This product has a U.S. Pat. Nos. 4,505,499 and 4,799,713.

Marathon Roofing Products, Inc. of Buffalo, N.Y., has a U.S. Pat. No. 4,759,163, on a one-piece elastomeric seal that must be expanded in a similar manner to the U-Flow seal described above.

The RAC Roof Accessories Company, Inc., U.S. Pat. No. 5,141,633, includes a rubber seal to seal against back flow, constructed of a one-piece urethane member that extends below a frusto-conical lower end of the outlet pipe in the system that assists in urging the seal outwardly against the drain pipe. This seal is essentially just a thin annular ring except for the lower frusto-conical portion.

Other prior art utilizes a one-piece elastomeric seal having a plurality of thin annular rings there-around that are integral with the seal. One such manufacturer is Zurn Industries, Inc. of Pittsburgh, Pa. Another re-roofing seal is made by Thaler Metal Industries, Inc., Model No. M-22, and this system includes a one-piece elastomeric seal constructed of EPDM Posiseal that is similar in construction to the Zurn seal described above. Unlike the present invention, this type seal does not account for misalignment and could leak when witnessing high fluid pressure.

In all cases, prior art has shortcomings since each has its own unique problem with assembly methods, installer skill or tool requirements, self-alignment, and their inability to withstand high pressure when the drain becomes full and/or flow is reversed.

In short, the above prior art systems have been found to be both difficult to insert into the existing drain pipe and include difficult and complicated mechanisms for expanding the seal, and have not been found under testing to prevent leakage at backup pressures in excess of 50 column feet.

For the above reasons, it is a primary object of the present invention to provide a roof drain system with a seal for sealing the drain system to the drain pipe interior and eliminate the many problems noted above in prior art seals.

SUMMARY OF THE PRESENT INVENTION

In accordance with the present invention, a roof drain system is provided for existing roofs or new construction including a flanged outlet pipe for insertion into the roof drain pipe with the flange mounted on top of the roof. A water straining system is mounted on top of the flange. The outlet pipe is sealed to the interior of the drain pipe by a one-piece rubber molding seal that flexes to easily slide into the drain pipe and withstands high backup water pressures from the drain pipe without leaking. The seal has a Shore A durometer in the range of 30 to 95 and has an annular portion engaging the outer surface of the outlet pipe and an integral flange portion extending outwardly and downwardly from the upper end of the annular portion that seals the inner surface of the drain pipe.

The present seal eliminates the necessity for complicated seal expanding components noted above in many of the prior art drain pipe sealing devices in roof drain systems. Toward these ends, the present seal includes the annular portion noted above that has a radial flange that engages the extreme lower end of the outlet pipe and this axially locates the seal with respect to the outlet pipe and furthermore resists upward movement of the seal relative to the outlet pipe upon backup water pressure in the drain pipe.

The seal is constructed of rubber but could also be constructed of other materials such as poly-urethane. It is a one-piece molding and the flange is spheroidal in configuration and has a radius of about 1.5 inches about a center spaced about 0.535 inches from the axial center line of the seal. In the 4 inch seal, i.e.; designed to seal against a 4 inch diameter drain pipe, the flange is flexible and forms a hydrostatic pocket between itself and the outer surface of the seal annular portion. Water pressure in this pocket serves to expand the frusto-spheroidal flange into engagement with the drain pipe interior as backup water pressure increases, providing a very effective seal and eliminating any seal leakage at backup pressures as high as 50 column feet or more.

Other objects and advantages of the present invention will appear more clearly from the following detailed description.

DETAILED DESCRIPTION OF THE PREFERRED EMBODIMENT

Figure 1:
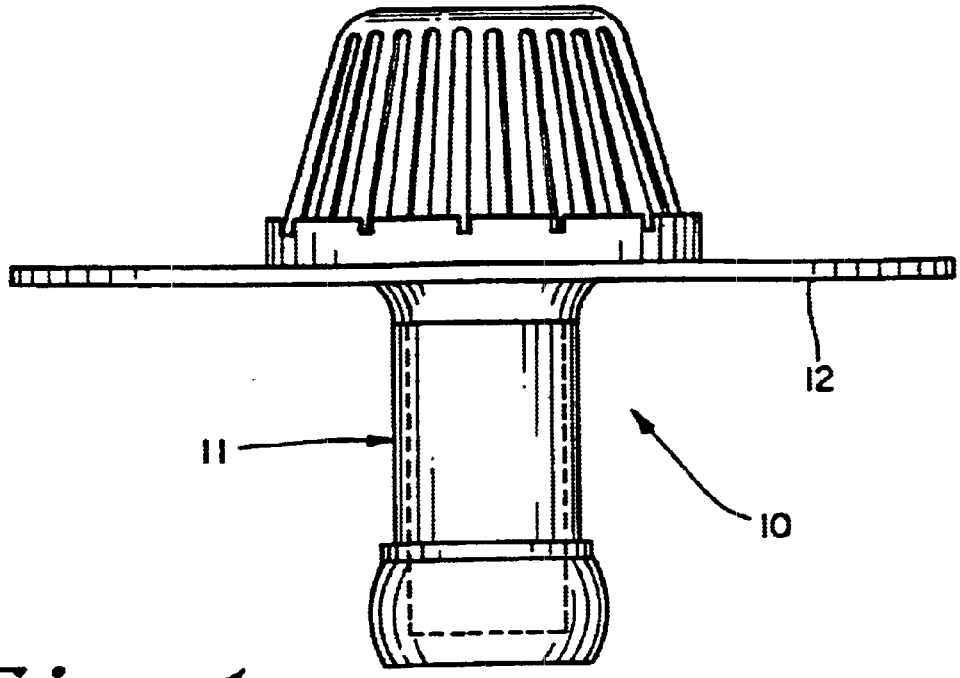
FIG. 1 is a front plan view of a roof drain system according to the present invention.
Figure 2:
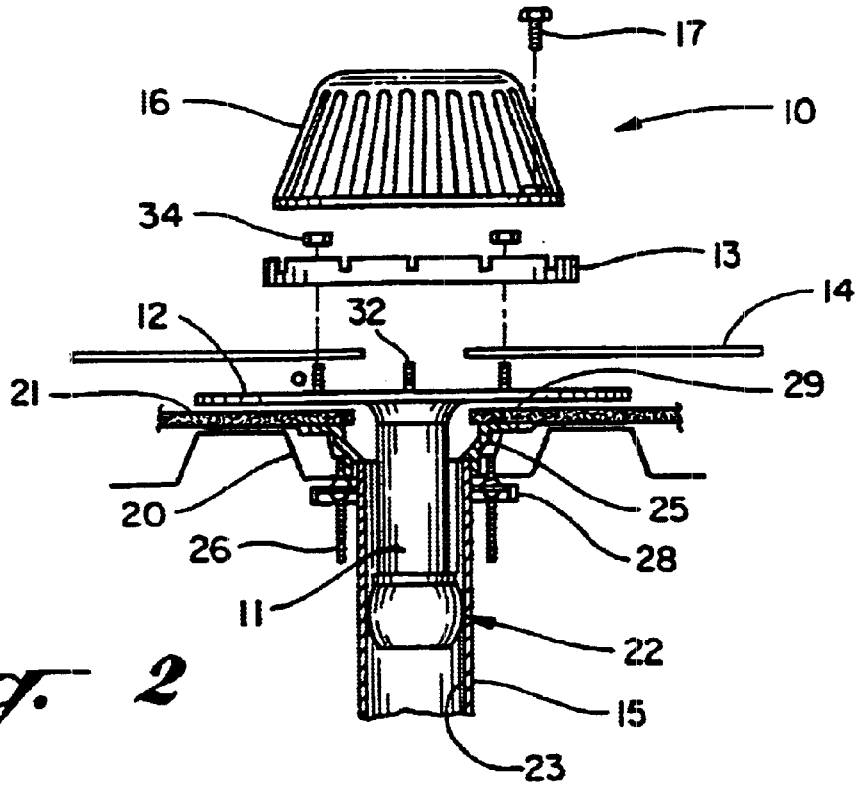
FIG. 2 is an exploded, partly in section view, of the roof drain system according to the present invention shown installed into an existing roof and drain pipe assembly.
Figure 3:
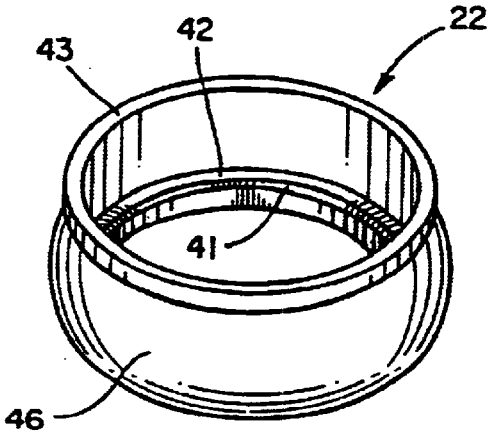
FIG. 3 is a perspective view of the present roof drain seal.
Figure 4:
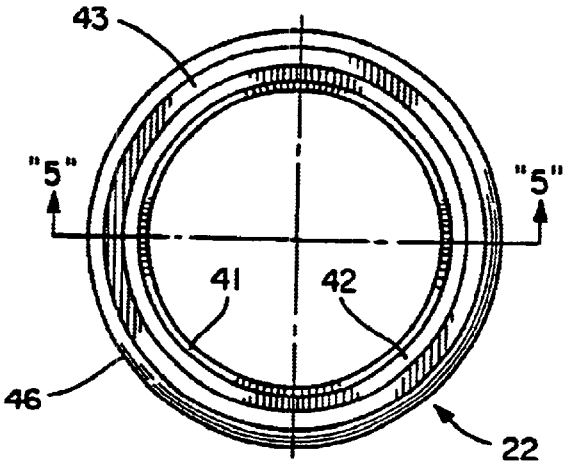
FIG. 4 is a top view of the roof drain seal shown in FIG. 3.

Referring to the drawings and particularly FIGS. 1 and 2, a roof draining system is illustrated generally designated by the reference numeral 10 and is seen to include an outlet pipe 11 adapted to be inserted into an existing drain pipe 15, having fixed thereto a flat upper annular flange 12, to which a gravel guard collar or ring 13 is fastened, clamping a roofing membrane 14 there-between, and a dome-type straining molding 16 fastened to the ring by a plurality of fasteners 17.

The existing roof construction illustrated in FIG. 2 includes a corrugated sheet metal roof 20 covered by an insulation panel 21.

The flange 12 is fixed to the upper end of the outlet pipe 11 and the outlet pipe 11 has an annular seal 22, according to the present invention, that seals the outlet pipe to drain pipe interior surface 23. The upper end of the drain pipe 15 carries a bell housing 25 that is attached thereto by a plurality of fasteners 26 that extend through a drain pipe collar 28 and into a bell housing flange 29.

The outlet pipe flange 12 has a plurality of fasteners 32 projecting upwardly therefrom that extend through gravel collar 13 and are attached thereto by a plurality of nuts 34.

As seen in FIGS. 3 to 6, the seal 22 is a one-piece elastomeric molding preferably constructed of EPDM rubber, but other materials such as polyurethane with a similar durometer could be substituted. The seal 22 has a Shore A durometer in the range of 30 to 95, but preferably about Shore A 55 to minimize back pressure leakage from the drain pipe 15.

The seal 22 includes an annular portion 40 that engages the outer diameter of the lower end of the outlet pipe 11 and annular portion 40 has an inner diameter slightly less than the outer diameter of the outlet pipe 11 to securely hold the seal on the end of the outlet pipe. To further axially position the seal 22 with respect to the outlet pipe, a radially inward directed rim portion 41 is provided on the lower end of the annular portion 40 and it has an upper surface 42 that engages the radial end surface at the lower end of the outlet pipe 11 and this design further assists in resisting back pressure or upward pressure on the seal 22 caused by back pressure in the drain pipe 15. The annular portion, including the rim 41, has an axial length of about 1.250 inches for the 4 inch model of the present drain seal(all dimensions herein are for the 4 inch model), and it should be understood that the seal assemblies for the other size drain pipes are proportionately similar. Annular portion 40 has a wall thickness of about 0.075 inches below a heavier annular upper portion 43, which has a thickness of about 0.200 inches. Just below annular portion 43, a semi-spheroidal annular flange portion 46 is provided that engages the inner surface 23 of the drain pipe 15 to seal the outlet pipe 11 to the drain pipe and prevent back leakage from the drain pipe upwardly into the roof area.

Figure 5:
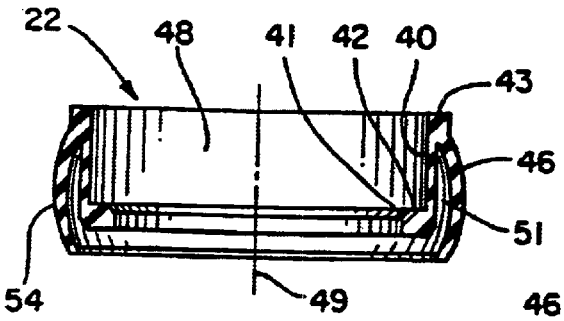
FIG. 5 is a longitudinal section of the roof drain seal according to the present invention.
Figure 6:
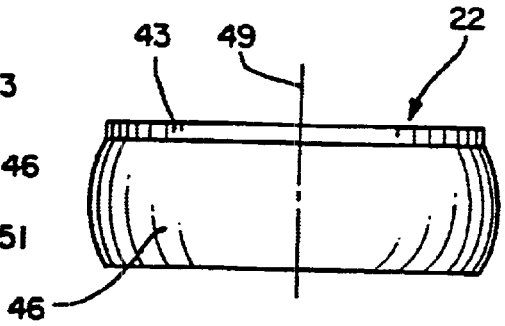
FIG. 6 is a front plan view of the roof drain seal according to the present invention.

The flange portion 46 has a radius of about 1.500 inches (again in the 4 inch version) scribed about a center 48 that is offset radially from seal axis 49 about 0.535 inches. The flange portion 46 has a decreasing wall thickness from annular portion 43 to its end 49 beginning at approximately 0.125 inches, decreasing to about 0.080 inches. The flange portion 46 forms an annular pocket 51 between its inner surface and the outer surface of the annular portion 40 which provides a hydrostatic reservoir for water back pressure within the drain pipe 15. This hydrostatic pressure in pocket 51 forces the flange portion 46 radially outwardly against the interior 23 of the drain pipe 15 increasing the sealing characteristics of the seal in response to increasing water back pressure. The relaxed maximum outer diameter of the flange portion 46 taken at about 54 in FIG. 5 is 4.060 inches, somewhat greater than the interior diameter of 4.00 inches of the existing drain pipe.

What is claimed is:

1. A roof drain system for annular roof drain pipes connected to a generally flat roof, comprising: a drain outlet pipe adapted to be inserted into the annular roof drain pipe, said outlet pipe having a flange for attachment to the roof, and a seal on the outside of the outlet pipe having a relaxed diameter about the same as the internal diameter of the roof drain pipe, said seal being constructed of a molded elastomeric material having an annular portion engaging the outer surface of the outlet pipe and an integral flange portion extending outwardly and downwardly from an upper portion of the annular portion, and means for preventing backup water pressure from escaping around the seal including said integral flange portion expanding against the roof drain pipe in response to backup water pressure against the inside of the integral flange portion.

2. A roof drain system as defined in claim 1, wherein the seal is constructed of a one-piece rubber elastomer having a Shore A durometer in the range of 30 to 95.

3. A roof drain system as defined in claim 1, wherein the seal has a Shore A durometer about 55.

4. A roof drain system as defined in claim 1, wherein the annular portion of the seal has an annular flange portion at the lower end thereof adapted to engage the lower end of the outlet pipe and to axially locate the seal relative to the outlet pipe.

5. A roof drain system as defined in claim 1, wherein the flange portion is semi-spheroidal in shape.

6. A roof drain as defined in claim 1, wherein the flange portion is arcuate in cross-section and has an inner surface radially spaced from the outer surface of the annular portion.

7. A roof drain system for annular roof drain pipes connected to a generally flat roof, comprising: a drain outlet pipe adapted to be inserted into the annular roof drain pipe, said outlet pipe having a flange for attachment to the roof, and a seal on the outside of the outlet pipe having a relaxed diameter about the same as the internal diameter of the roof drain pipe, said seal being constructed of a molded elastomeric material having an annular portion engaging the outer surface of the outlet pipe and an integral flange portion extending outwardly and downwardly from an upper portion of the annular portion, the seal being constructed of a one-piece rubber elastomer having a Shore A durometer in the range of 30 to 95, and the annular portion of the seal having an annular rim portion at the lower end thereof adapted to engage the lower end of the outlet pipe and to axially locate the seal relative to the outlet pipe, and means for preventing backup water pressure from escaping around the seal including said integral flange portion expanding against the roof drain pipe in response to backup water pressure against the inside of the integral flange portion.

8. A roof drain system for annular roof drain pipes connected to a generally flat roof, comprising: a drain outlet pipe adapted to be inserted into the annular roof drain pipe, said outlet pipe having a flange for attachment to the roof, and a seal on the outside of the outlet pipe having a relaxed diameter about the same as the internal diameter of the roof drain pipe, said seal being constructed of a molded elastomeric material having an annular portion engaging the outer surface of the outlet pipe and an integral flange portion extending outwardly and downwardly from an upper portion of the annular portion, the flange portion being semi-spheroidal in shape, and the flange portion being arcuate in cross-section and having an inner surface radially spaced from the outer surface of the annular portion, and means f or preventing backup water pressure from escaping around the seal including said integral flange portion expanding against the roof drain pipe in response to backup water pressure against the inside of the integral flange portion.

9. A roof drain system for annular roof drain pipes connected to a generally flat roof, comprising: a drain outlet pipe adapted to be inserted into the annular roof drain pipe, said outlet pipe having a flange for attachment to the roof, and a seal on the outside of the outlet pipe having a relaxed diameter about the same as the internal diameter of the roof drain pipe for preventing the entry of backup water from the roof draining to the area beneath the roof including said seal being constructed of a molded elastomeric material having an annular portion engaging the outer surface of the outlet pipe and an integral flange portion extending outwardly and downwardly from an upper portion of the annular portion, the flange portion being semi-spheroidal in shape, and the flange portion being arcuate in cross-section and having an inner surface radially spaced from the outer surface of the annular portion, said flange portion being sufficiently flexible to permit the insertion of the outlet pipe into the drain pipe and to increase sealing pressure against the drain pipe upon water backup from the drain pipe, and means for preventing backup water pressure from escaping around the seal including said integral flange portion expanding against the roof drain pipe in response to backup water pressure against the inside of the integral flange portion.

10. A roof drain system as defined in claim 8, wherein the seal is constructed of a one-piece rubber elastomer having a Shore A durometer in the range of 30 to 95 to minimize backup leakage past the seal.

11. A roof drain system as defined in claim 8, wherein the seal has a Shore A durometer about 55.

12. A roof drain system as defined in claim 8, wherein the annular portion of the seal has an annular rim portion at the lower end thereof adapted to engage the lower end of the outlet pipe and to axially locate the seal relative to the outlet pipe, the flange portion is semi-spheroidal in shape, and the flange portion is arcuate in cross-section and has an inner surface radially spaced from the outer surface of the annular portion.

13. A roof drain system for annular roof drain pipes connected to a generally flat roof, comprising: a drain outlet pipe adapted to be inserted into the annular roof drain pipe, said outlet pipe having a flange for attachment to the roof, and a seal on the outside of the outlet pipe having a relaxed diameter about the same as the internal diameter of the roof drain pipe, said seal being constructed of a molded elastomeric material having an annular portion engaging the outer surface of the outlet pipe and an integral flange portion extending outwardly and downwardly from an upper portion of the annular portion, the flange portion being semi-spheroidal in shape, and the flange portion being arcuate in cross-section and having an inner surface radially spaced from the outer surface of the annular portion, said seal being constructed of a one-piece rubber elastomer having a Shore A durometer about 55, the annular portion of the seal having an annular rim portion at the lower end thereof adapted to engage the lower end of the outlet pipe and to axially locate the seal relative to the outlet pipe, and the flange portion being arcuate in cross-section and having an inner surface radially spaced from the outer surface of the annular portion, and means for preventing backup water pressure from escaping around the seal including said integral flange portion expanding against the roof drain pipe in response to backup water pressure against the inside of the integral flange portion.

* * * * *